US008985718B2

(12) United States Patent
Chen et al.

(10) Patent No.: US 8,985,718 B2
(45) Date of Patent: Mar. 24, 2015

(54) REFRIGERATOR AND DOOR LOCKING ASSEMBLY FOR THE SAME

(75) Inventors: Hao Chen, Hefei (CN); Haixing Zhang, Hefei (CN)

(73) Assignees: Hefei Midea Refrigerator Co., Ltd., Hefei (CN); Hefei Hualing Co., Ltd., Hefei (CN)

( * ) Notice: Subject to any disclaimer, the term of this patent is extended or adjusted under 35 U.S.C. 154(b) by 0 days.

(21) Appl. No.: 14/363,343

(22) PCT Filed: Dec. 6, 2011

(86) PCT No.: PCT/CN2011/083585

§ 371 (c)(1),
(2), (4) Date: Jun. 6, 2014

(87) PCT Pub. No.: WO2013/082765

PCT Pub. Date: Jun. 13, 2013

(65) Prior Publication Data

US 2014/0327354 A1 Nov. 6, 2014

(51) Int. Cl.

| | |
|---|---|
| ***A47B 96/04*** | (2006.01) |
| ***E05B 65/00*** | (2006.01) |
| ***F25D 23/02*** | (2006.01) |

(52) U.S. Cl.

CPC ..... *E05B 65/0042* (2013.01); *F25D 23/02* (2013.01); *F25D 23/028* (2013.01)

USPC ..... 312/405

(58) Field of Classification Search

CPC .... F25D 23/02; F25D 23/028; E05B 65/0042

USPC ..... 312/405, 324, 215, 222

See application file for complete search history.

(56) References Cited

U.S. PATENT DOCUMENTS

| | | | | | |
|---|---|---|---|---|---|
| 2,256,447 | A * | 9/1941 | Burke | 292/223 |
| 2,451,381 | A * | 10/1948 | Curtiss, Jr. | 292/332 |
| 2,681,819 | A * | 6/1954 | Burke | 292/226 |
| 3,161,923 | A * | 12/1964 | Crain | 292/128 |
| 3,621,684 | A * | 11/1971 | Horvay et al. | 70/73 |
| 4,930,818 | A * | 6/1990 | Gerhardsson | 292/29 |
| 7,097,213 | B2 * | 8/2006 | Antos et al. | 292/56 |
| 8,025,349 | B2 * | 9/2011 | Lim et al. | 312/405 |
| 8,147,015 | B2 * | 4/2012 | Kim et al. | 312/405 |
| 2005/0200253 | A1 * | 9/2005 | Wissinger et al. | 312/405 |
| 2009/0007608 | A1 * | 1/2009 | Lorek | 70/144 |
| 2014/0203698 | A1 * | 7/2014 | Kim et al. | 312/404 |
| 2014/0232251 | A1 * | 8/2014 | Kim et al. | 312/404 |

FOREIGN PATENT DOCUMENTS

| | | |
|---|---|---|
| CN | 1307167 | 8/2001 |
| JP | 10266674 | 10/1998 |

* cited by examiner

*Primary Examiner* — Daniel Rohrhoff
(74) *Attorney, Agent, or Firm* — Hodgson Russ LLP

(57) ABSTRACT

A door locking assembly for a refrigerator includes a pivoting shaft (20) mounted on the door (80) of a refrigerator along a vertical direction. A rotating member (30) defines a first end (31) pivotably connected with the pivoting shaft (20) and a second end (32). The elastic member (40) defines a first end (41) fixed on the door (80) and a second end (42) connected with the rotating member (30) so as to apply a force on the rotating member (30). A stopping member (10) is disposed on the door (80) and configured to stop the rotating member (30) at a predetermined position. The positioning member (50) is disposed on the cabinet (90) of the refrigerator and configured to engage with the second end (32) of the rotating member (30) so as to lock the door (80) onto the cabinet (90) when the door (80) is closed.

7 Claims, 2 Drawing Sheets

REFRIGERATOR AND DOOR LOCKING ASSEMBLY FOR THE SAME

FIELD

Embodiments of the present disclosure relate to the field of refrigeration, and more particularly to a refrigerator and a door locking assembly for the refrigerator.

BACKGROUND

The existing refrigerators such as French side by side type refrigerator and Japanese multiple-door type refrigerator have a large refrigeration compartment which is convenient for use. In the refrigerator having two doors disposed side by side, a movable rotating beam needs to be provided between the two doors in order to seal the refrigeration compartment. Due to the poor stopping effect, the door on one side may be opened because of the air pressure during closing the door on the other side, thus causing refrigeration leakage of the refrigerator.

SUMMARY

Embodiments of the present disclosure seek to solve at least one of the problems existing in the related art to at least some extent.

Accordingly, an object of the present disclosure is to provide a door locking assembly for a refrigerator. The door locking assembly may lock a door of the refrigerator onto the refrigerator body of the refrigerator.

Another object of the present disclosure is to provide a refrigerator including the above-identified door locking assembly.

In order to achieve the above objects, embodiments of a first aspect of the present disclosure provide a door locking assembly for a refrigerator. The refrigerator includes a door and a cabinet, and the locking assembly includes: a pivoting shaft mounted on the door along a vertical direction; a rotating member defining a first end pivotably connected with the pivoting shaft and a second end; an elastic member defining a first end fixed on the door and a second end connected with the rotating member so as to apply a force on the rotating member; a stopping member disposed on the door and configured to stop the rotating member at a predetermined position; and a positioning member disposed on the cabinet and configured to engage with the second end of the rotating member so as to lock the door onto the cabinet when the door is closed.

With the door locking assembly for a refrigerator according to embodiments of the present disclosure, when the door is closed, the door may be locked tightly by means of the positioning member via the rotating member, thus locking the door onto the cabinet. Thereby, even when the air pressure in a refrigeration compartment of the cabinet is increased suddenly, the door may not be opened. The door is locked tightly on the cabinet, and then the refrigeration leakage of the refrigerator is prevented efficiently.

In addition, the door locking assembly according to embodiments of the present disclosure may further have the following features.

In some embodiments, the second end of the rotating member has a first hook, and the positioning member has a second hook adapted to engage with the first hook.

In some embodiments, the elastic member and the stopping member are positioned on the same side of the rotating member, and the elastic member is configured to apply a tensile force on the rotating member.

In some embodiments, the elastic member and the stopping member are positioned on opposite sides of the rotating member respectively, and the elastic member is configured to apply a compression force on the rotating member.

In some embodiments, the positioning member is disposed on a hinge configured to connect the door and the cabinet.

In some embodiments, the hinge is a top-mounted hinge, and a groove is formed in an upper end of the door and adapted to receive the stopping member, the pivoting shaft, the rotating member and the elastic member.

In some embodiments, the stopping member is disposed such that the rotating member is perpendicular to the door when the door is closed.

In some embodiments, the door locking assembly further includes a snapping groove is formed in the positioning member, and the second end of the rotating member has a protrusion adapted to be elastically engaged into the snapping groove.

Embodiments of a second broad aspect of the present disclosure provide a refrigerator. The refrigerator includes: a cabinet defining a refrigeration compartment therein; a door pivotably connected with the cabinet via a hinge to open and close the refrigeration compartment; and the above-identified door locking assembly configured to lock the door onto the cabinet.

The refrigerator according to embodiments of the present disclosure has the door locking assembly. When the door is closed, the door may be locked tightly with the positioning member via the rotating member, thus locking the door onto the cabinet. Thereby, even when the air pressure in the refrigeration compartment of the cabinet is increased suddenly, the door may not be opened. The door is locked tightly on the cabinet, and then the refrigeration leakage of the refrigerator is prevented efficiently.

In some embodiments, the refrigerator is configured as side by side type refrigerator including two doors arranged side by side, and the refrigerator includes two door locking assemblies adapted to lock the two doors onto the cabinet respectively.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
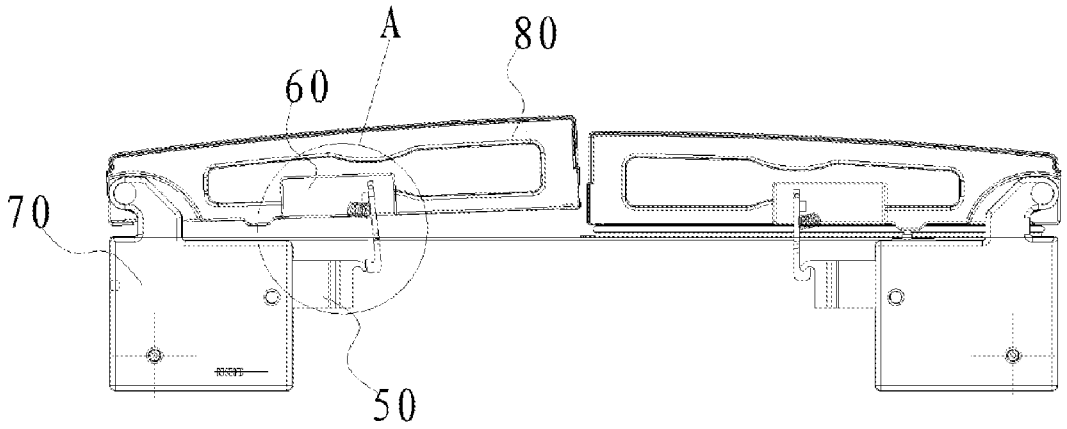
FIG. 1 is a schematic view of a door locking assembly for a refrigerator according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it should be understood that, the terms such as "central", "longitudinal", "lateral", "width", "thickness", "above", "below", "front", "rear", "right", "left", "vertical", "horizontal", "top", "bottom", "inner", "outer", "clockwise", "counter-clockwise" should be construed to refer to the orientation as then described or as shown in the drawings. These terms are merely for convenience and concision of description and do not alone indicate or imply that the device or element referred to must have a particular orientation. Thus, it cannot be understood to limit the present disclosure.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A door locking assembly for a refrigerator according to embodiments of the present disclosure will be described below with reference to the drawings.

Figure 2:
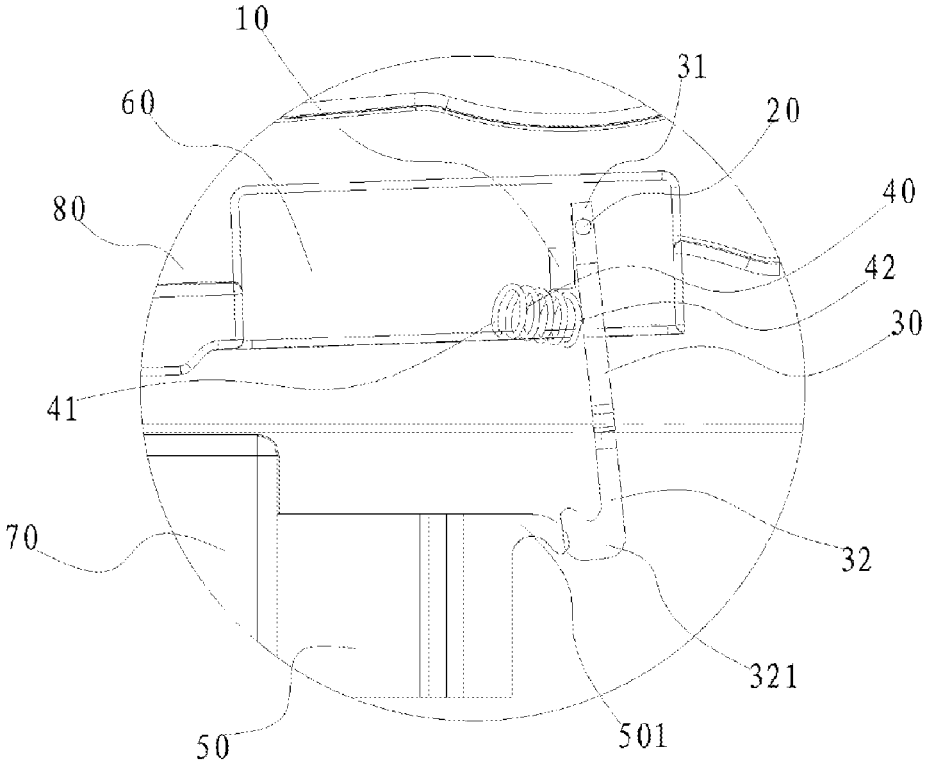
FIG. 2 is an enlarged view of part A in FIG. 1.
Figure 3:
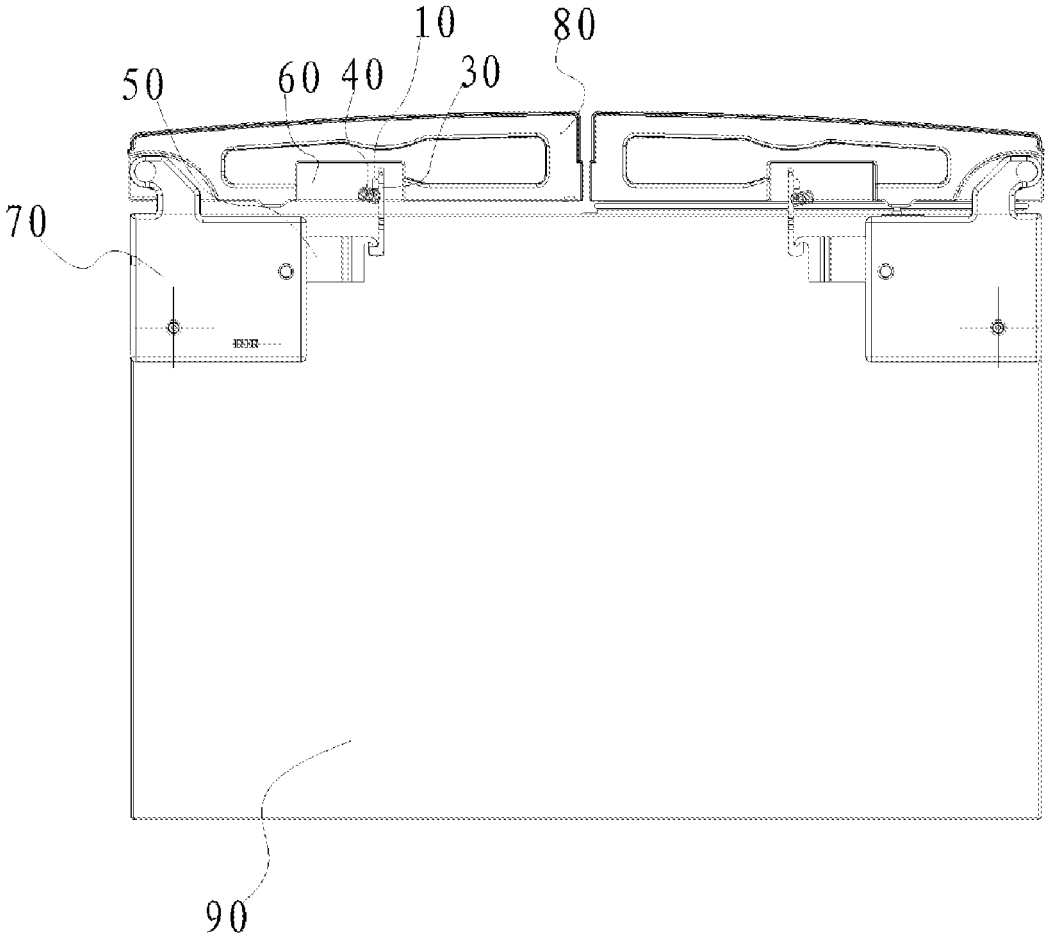
FIG. 3 is a top view of a refrigerator according to an embodiment of the present disclosure.

As shown in FIGS. 1-3, the refrigerator includes a door 80 and a cabinet 90, and the door locking assembly for a refrigerator according to embodiments of the present disclosure includes a stopping member 10, a pivoting shaft 20, a rotating member 30, an elastic member 40 and a positioning member 50.

Specifically, the stopping member 10 is disposed on the door 80. Alternatively, the stopping member 10 may be fixed on the door 80.

The pivoting shaft 20 is mounted on the door 80 along a vertical direction, for example, the vertical direction is perpendicular to the paper sheet in FIG. 1.

The rotating member 30 defines a first end 31 pivotably connected with the pivoting shaft 20 so as to rotate about the pivoting shaft 20 in the horizontal plane, for example, the plane defined by the paper sheet, and a second end 32. The stopping member 10 is configured to stop the rotating member 30 at a predetermined position.

The elastic member 40 defines a first end 41 fixed on the door 80 and a second end 42 connected with the rotating member 30, so as to apply a force on the rotating member 30 and to abut the rotating member 30 against the stopping member 10.

The positioning member 50 is disposed on the cabinet 90 and configured to engage with the second end 32 of the rotating member 30 so as to lock the door 80 onto the cabinet 90 when the door 80 is closed.

With the door locking assembly for a refrigerator according to embodiments of the present disclosure, when the door 80 is in a closed state, the door 80 may be locked tightly with the positioning member 50 via the rotating member 30, thus locking the door 80 onto the cabinet 90. In this way, even when the air pressure in a refrigeration compartment of the cabinet 90 is increased suddenly, the door 80 may not be opened. The door 80 is locked tightly on the cabinet 90, which ensures that the refrigeration leakage of the refrigerator is prevented efficiently.

As shown in FIG. 2, in some embodiments, the second end 32 of the rotating member 30 has a first hook 321, and the positioning member 50 has a second hook 501 adapted to engage with the first hook 321.

In other words, the rotating member 30 and the positioning member 50 are engaged with each other via the first hook 321 formed at the rotating member 30 and the second hook 501 formed at the positioning member 50. Thereby, when the door 80 is closed, the first and second hooks 321, 501 are engaged to lock the rotating member 30 and the positioning member 50, thus locking the door 80 onto the cabinet 90 via the rotating member 30 and the positioning member 50.

As shown in FIG. 2, the elastic member 40 and the stopping member 10 are positioned on the same side of the rotating member 30, and the elastic member 40 is configured to apply a tensile force on the rotating member 30. For example, the elastic member 40 may be a spring. Thereby, the rotating member 30 may be driven by the tensile force of the elastic member 40 such as a spring and abuts against the stopping member 10, thus positioning at a predetermined position with regard to the door 80. For example, the predetermined position is advantageous for locking the rotating member 30 and the positioning member 50.

Alternatively, the elastic member 40 and the stopping member 10 are positioned on opposite sides of the rotating member 30 respectively, and the elastic member 40 is configured to apply a compression force on the rotating member 30. Thereby, the rotating member 30 may be driven by the compression force of the elastic member 40 such as a spring and abuts against the stopping member 10, thus positioning at a predetermined position with regard to the door 80. For example, the predetermined position is advantageous for locking the rotating member 30 and the positioning member 50.

As shown in FIG. 1, according to some embodiments of the present disclosure, the positioning member 50 is disposed on a hinge 70 configured to connect the door 80 and the cabinet 90. Thereby, the arrangement of the positioning member 50 may be achieved without significant adjustment on the structure of a conventional refrigerator. Then the manufacturing cost is reduced.

In some embodiments, the hinge 70 is a top-mounted hinge, and a groove 60 is formed in an upper end of the door 80 and adapted to receive the stopping member 10, the pivoting shaft 20, the rotating member 30 and the elastic member 40. The groove 60 and the top-mounted hinge are corresponding to each other in position, thus facilitating to engage the rotating member 30 with the positioning member 50. The door locking assembly according to embodiments of the present disclosure may be arranged externally of the refrigeration compartment of the refrigerator, thus the reliability of the door locking assembly during use may be improved.

As shown in FIG. 3, In some embodiments, the stopping member 10 is disposed such that the rotating member 30 is perpendicular to the door 80 when the door 80 is closed. In other words, by the driving of the elastic member 40 and the stop of the stopping member 10, the rotating member 30 is positioned perpendicularly to the door 80 when the door 80 is closed. Thereby, when the door 80 is in the closed state, the rotating member 30 and the positioning member 50 may be locked tightly with each other.

In some embodiments, a snapping groove (not shown) is formed in the positioning member 50, and the second end 32 of the rotating member 30 has a protrusion (not shown) adapted to be elastically engaged into the snapping groove. When the door 80 is in the closed state, the protrusion is inserted in the snapping groove in order to lock the door 80 on the cabinet 90.

The operation process of the door locking assembly for a refrigerator according embodiments of the present disclosure will be described below with reference to the drawings.

When the door 80 changes from an open state to a closed state, the rotating member 30 is perpendicular to the door 80. During the rotating process of the door 80, the first hook 321 of the rotating member 30 is contacted with the second hook 501 of the positioning member 50. As the door 80 keeps on rotating, the rotating member 30 is rotated about the pivoting shaft 20 due to the interaction between the first and second hooks 321, 501. Then the elastic member 40, such as a spring, is stretched (as shown in FIG. 1). When a closing angle (for example, the closing angle is defined by a plane of the door 80 and a plane of the front side of the cabinet 90) is smaller than a predetermined angle such as 2 degrees, the rotating member 30 rotates along a reversed direction by the tensile force of the spring, until the first and second hooks 321, 501 are engaged with each other. In this way, the door 80 and the cabinet 90 are locked tightly with each other.

When the door 80 changes from the closed state to the open state, the operation process of the door locking assembly for a refrigerator according to embodiments of the present disclosure is in contrary to the operation process described above (i.e. the operation process during the door 80 changing from the open state to the closed state), thus details thereof are omitted herein.

As shown in FIG. 3, a refrigerator is provided. The refrigerator according to embodiments of the present disclosure includes a cabinet 90, a door 80 and a door locking assembly as described above.

Specifically, the cabinet 90 defines a refrigeration compartment (now shown) therein.

The door 80 is pivotably connected with the cabinet 90 via a hinge 70 and configured to open and close the refrigeration compartment.

The door locking assembly is the above-identified door locking assembly according to embodiments of the present disclosure, and configured to lock the door 80 onto the cabinet 90.

The refrigerator according to embodiments of the present disclosure has the door locking assembly. When the door 80 is in a closed state, the door 80 may be locked tightly on the positioning member 50 via the rotating member 30, thus locking the door 80 onto the cabinet 90. In this way, even when the air pressure in the refrigeration compartment is increased suddenly, the door 80 may not be opened. The door 80 is locked tightly on the cabinet 90, which ensures that the refrigeration leakage of the refrigerator is prevented efficiently.

In some embodiments, the refrigerator is configured as a side by side type refrigerator. The side by side type refrigerator may include two doors arranged side by side, and the refrigerator includes two door locking assemblies adapted to lock the two doors onto the cabinet respectively. Thereby, when the air pressure in the refrigeration compartment is increased suddenly, for example, during a process that one door changes from the open state to the closed state while the other door is in the closed state, the other door being opened due to the increased air pressure may be efficiently prevented by using the refrigerator according to embodiments of the present disclosure.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A door locking assembly for a refrigerator, the refrigerator comprising a door and a cabinet, the locking assembly comprising:

a pivoting shaft mounted on the door along a vertical direction;

a rotating member defining a first end pivotably connected with the pivoting shaft and a second end;

an elastic member defining a first end fixed on the door and a second end connected with the rotating member so as to apply a force on the rotating member;

a stopping member disposed on the door and configured to stop the rotating member at a predetermined position; and a positioning member disposed on the cabinet and configured to engage with the second end of the rotating member so as to lock the door onto the cabinet when the door is closed;

wherein the second end of the rotating member has a first hook, and the positioning member has a second hook adapted to engage with the first hook;

wherein the elastic member and the stopping member are positioned on the same side of the rotating member, and the elastic member is configured to apply a tensile force on the rotating member;

wherein the positioning member is disposed on a hinge configured to connect the door and the cabinet.

2. The door locking assembly according to claim 1, wherein the hinge is a topmounted hinge, and a groove is formed in an upper end of the door and adapted to receive the stopping member, the pivoting shaft, the rotating member and the elastic member.

3. The door locking assembly according to claim 1, wherein the stopping member is disposed such that the rotating member is perpendicular to the door when the door is closed.

4. A refrigerator comprising:

a cabinet defining a refrigeration compartment therein;

a door pivotably connected with the cabinet via a hinge to open and close the refrigeration compartment;

a door locking assembly configured to lock the door onto the cabinet, wherein the door locking assembly comprises:

a pivoting shaft mounted on the door along a vertical direction;

a rotating member defining a first end pivotably connected with the pivoting shaft and a second end;

an elastic member defining a first end fixed on the door and a second end connected with the rotating member so as to apply a force on the rotating member;

a stopping member disposed on the door and configured to stop the rotating member at a predetermined position; and a positioning member disposed on the cabinet and configured to engage with the second end of the rotating member so as to lock the door onto the cabinet when the door is closed;

wherein the second end of the rotating member has a first hook, and the positioning member has a second hook adapted to engage with the first hook;

wherein the elastic member and the stopping member are positioned on the same side of the rotating member, and the elastic member is configured to apply a tensile force on the rotating member;

wherein the positioning member is disposed on the hinge configured to connect the door and the cabinet.

5. The refrigerator according to claim 4, wherein the refrigerator is configured as a side by side type refrigerator comprising two doors arranged side by side, and the refrigerator comprises two door locking assemblies adapted to lock the two doors onto the cabinet respectively.

6. The door locking assembly according to claim 4, wherein the hinge is a topmounted hinge, and a groove is formed in an upper end of the door and adapted to receive the stopping member, the pivoting shaft, the rotating member and the elastic member.

7. The door locking assembly according to claim 4, wherein the stopping member is disposed such that the rotating member is perpendicular to the door when the door is closed.

* * * * *